US008443462B1

(12) United States Patent
Eugene

(10) Patent No.: US 8,443,462 B1
(45) Date of Patent: May 21, 2013

(54) ATHLETIC GRIP ENHANCING FINGER GLOVES

(76) Inventor: Jamelle Brian Eugene, Naples, FL (US)

( * ) Notice: Subject to any disclaimer, the term of this patent is extended or adjusted under 35 U.S.C. 154(b) by 72 days.

(21) Appl. No.: 13/291,541

(22) Filed: Nov. 8, 2011

(51) Int. Cl.
*A41D 13/05* (2006.01)
*A63B 71/14* (2006.01)
*A41D 13/08* (2006.01)

(52) U.S. Cl.
USPC ..... 2/21; 2/16; 2/20; 2/161.1

(58) Field of Classification Search ..... 2/1, 21, 2/19, 163, 167, 168
See application file for complete search history.

(56) References Cited

U.S. PATENT DOCUMENTS 3,728,736 A * 4/1973 Pugh ..... 2/21
4,027,060 A * 5/1977 Esemplare et al. ..... 428/212
4,062,540 A * 12/1977 Calentine ..... 473/60
4,082,862 A * 4/1978 Esemplare et al. ..... 427/133
4,183,100 A * 1/1980 De Marco ..... 2/159
4,507,804 A * 4/1985 Consigny ..... 2/21
4,507,807 A * 4/1985 Karkanen ..... 2/161.8
4,525,877 A * 7/1985 Chong ..... 2/161.1
4,694,843 A * 9/1987 Casenhiser ..... 132/73
4,704,742 A * 11/1987 Foster ..... 2/21
4,763,940 A * 8/1988 Held ..... 294/25
4,796,306 A * 1/1989 Mitchell ..... 473/205
4,858,246 A * 8/1989 Wiggins ..... 473/205
4,881,275 A * 11/1989 Cazares et al. ..... 2/161.1
4,881,276 A * 11/1989 Swan ..... 2/161.1
4,882,787 A * 11/1989 Hull et al. ..... 2/161.5
4,972,857 A * 11/1990 Stewart et al. ..... 132/73
4,977,621 A * 12/1990 Richard ..... 2/161.3
4,985,038 A * 1/1991 Lyell ..... 606/148
5,079,776 A * 1/1992 Crawford ..... 2/20
5,135,226 A * 8/1992 Place ..... 473/205
5,146,628 A * 9/1992 Herrmann et al. ..... 2/16
5,186,189 A * 2/1993 Harris ..... 132/285
D334,085 S * 3/1993 Niemann ..... D29/113
D335,938 S * 5/1993 Kam ..... D29/114
5,218,719 A * 6/1993 Johnson ..... 2/19
5,282,276 A * 2/1994 Preiose ..... 2/21
5,423,089 A * 6/1995 Chun et al. ..... 2/161.2
5,442,816 A * 8/1995 Seketa ..... 2/161.7
5,647,063 A * 7/1997 Bates ..... 2/21
5,689,828 A * 11/1997 Mah ..... 2/16
5,745,919 A * 5/1998 Kraatz ..... 2/161.6
D405,557 S * 2/1999 Lindsay ..... D29/114
5,881,388 A * 3/1999 Pratt ..... 2/163
5,970,521 A * 10/1999 Rabbeth ..... 2/161.1
5,971,240 A * 10/1999 Dequaine ..... 224/217
6,128,778 A * 10/2000 Castagneri ..... 2/21
6,363,535 B1 * 4/2002 Landis ..... 2/161.4
6,409,059 B1 * 6/2002 Calvert ..... 223/101
6,647,549 B2 * 11/2003 McDevitt et al. ..... 2/21
6,760,924 B2 * 7/2004 Hatch et al. ..... 2/161.5

(Continued)

*Primary Examiner* — Bobby Muromoto, Jr.
(74) *Attorney, Agent, or Firm* — James A. Italia; Italia IP

(57) ABSTRACT

Apparatus worn on the fingers similarly to gloves, to enhance grip, particularly suitable as an aid in catching sports balls. The apparatus having a sheath for each finger, which may bear a friction enhancing material on an external surface. Each sheath may be internally reinforced by members which are more resistant to bending than the constituent material of the sheath. Reinforcement members may comprise bands which extend circumferentially about sheaths or may extend axially along sheaths. Sheaths may be provided with internal elastic bands which may overlie other bands at acute angles thereto or which do not overlie other bands.

13 Claims, 7 Drawing Sheets

U.S. PATENT DOCUMENTS 6,837,796 B2 * 1/2005 Bernhardt ..... 473/61
6,839,905 B1 * 1/2005 Bruder et al. ..... 2/21
7,234,172 B1 * 6/2007 Hoelscher ..... 2/161.1
7,251,836 B2 * 8/2007 Santiago ..... 2/21
7,406,720 B2 * 8/2008 Hoelscher ..... 2/161.1
7,415,735 B2 * 8/2008 Erickson et al. ..... 2/163
7,735,153 B1 * 6/2010 Romiti ..... 2/163
8,261,938 B2 * 9/2012 Oradini, Sr. ..... 221/45
8,269,084 B2 * 9/2012 Ludwig ..... 84/315
2003/0140395 A1 * 7/2003 Newcomb ..... 2/160
2004/0045071 A1 * 3/2004 Robins ..... 2/21
2004/0068777 A1 * 4/2004 Wheelington, II ..... 2/161.1
2004/0221367 A1 * 11/2004 Darrow ..... 2/167
2005/0251942 A1 * 11/2005 Gunnarsson ..... 15/227
2005/0268369 A1 * 12/2005 Santiago ..... 2/21
2006/0185058 A1 * 8/2006 McGough ..... 2/163
2007/0079421 A1 * 4/2007 Davis ..... 2/163
2007/0118947 A1 * 5/2007 Lorenzo ..... 2/21
2008/0018123 A1 * 1/2008 Cox ..... 294/25
2008/0034466 A1 * 2/2008 Zicarelli ..... 2/158
2008/0040834 A1 * 2/2008 Schaller et al. ..... 2/161.7
2008/0120754 A1 * 5/2008 Raymond ..... 2/16
2008/0229477 A1 * 9/2008 McGough ..... 2/161.1
2008/0235850 A1 * 10/2008 Cabauy et al. ..... 2/161.8
2008/0244809 A1 * 10/2008 Hassan et al. ..... 2/161.8
2008/0276341 A1 * 11/2008 Duby ..... 2/16
2008/0282438 A1 * 11/2008 Boutaghou ..... 2/16
2009/0025120 A1 * 1/2009 Vestling ..... 2/161.1
2009/0139010 A1 * 6/2009 Bevier ..... 2/161.8
2009/0144880 A1 * 6/2009 Desjardin et al. ..... 2/161.1
2009/0183296 A1 * 7/2009 Hardee et al. ..... 2/161.8
2009/0255033 A1 * 10/2009 Chen et al. ..... 2/161.7
2009/0282606 A1 * 11/2009 Bordella et al. ..... 2/161.1
2010/0011483 A1 * 1/2010 Pinkart ..... 2/161.3
2010/0011484 A1 * 1/2010 Williams ..... 2/161.8
2010/0037364 A1 * 2/2010 Saunders et al. ..... 2/161.7
2010/0083420 A1 * 4/2010 Bouckaert ..... 2/161.1
2010/0186140 A1 * 7/2010 Ramirez ..... 2/161.1
2011/0035861 A1 * 2/2011 McDonald ..... 2/161.1
2011/0041225 A1 * 2/2011 Harvey et al. ..... 2/21
2011/0078841 A1 * 4/2011 Ketelsen ..... 2/160
2011/0252536 A1 * 10/2011 Hendon et al. ..... 2/160
2012/0017349 A1 * 1/2012 McCrane ..... 2/161.1
2012/0017350 A1 * 1/2012 McCrane ..... 2/161.1
2012/0017351 A1 * 1/2012 McCrane ..... 2/161.1
2012/0030857 A1 * 2/2012 Farago et al. ..... 2/161.1
2012/0151659 A1 * 6/2012 Sanabria et al. ..... 2/167
2012/0222186 A1 * 9/2012 Vena ..... 2/21
2012/0324623 A1 * 12/2012 Cabauy et al. ..... 2/167

* cited by examiner

ATHLETIC GRIP ENHANCING FINGER GLOVES

FIELD OF THE INVENTION

The present invention relates to performance enhancing apparel for the hands, and more particularly, to apparel for improving ability to catch or grasp moving objects.

BACKGROUND OF THE INVENTION

Athletes engaged in games having balls must periodically attempt to catch balls with their hands. In many sports, balls can be moving quite quickly. Consequently, considerable impact forces may be imposed on the hands. Also, a ball or other projectile may be spinning as well as moving along the ground quickly, which further complicates the action of catching the ball.

In the game of football for example, a ball may be thrown a considerable distance at considerable speed. Players from each team may attempt to catch the ball while running, which further complicates the issue of catching a ball.

Players have resorted to placing patches of tacky substances on their hands in an attempt to enhance their ability to catch a ball. However, tacky substances may objectionably transfer to the ball, may be difficult to remove after play is finished, and in some sports, may be banned.

There exists a need in the art for a way of improving grip which will assist in catching balls in dynamic environments.

SUMMARY OF THE INVENTION

The present invention addresses the above stated need by providing apparel worn on the hands which addresses those issues which pertain to activities such as catching balls. The apparel includes at a minimum a sleeve for each finger. The sleeve may comprise an exterior structural material which encircles and grips the finger. The sleeve may be complemented by internal structure for cushioning and reinforcing the finger, such as rubbery bands or somewhat stiff splints, by external structure improving frictional characteristics which assist in gripping a moving object such as a ball, or both.

The sleeves may extend the full length of the finger, or only along a more limited extent of the finger. Finger tips may be either exposed or covered by the sleeves.

The sleeves may be used in the absence of or with conventional gloves or other hand coverings, even including plaster casts which may be provided for medical purposes.

It is an object of the invention to provide practical, reusable devices for improving grasp of moving object such as sports balls.

Another object of the invention is to provide grasp improving apparatus which is compatible with conventional gloves.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
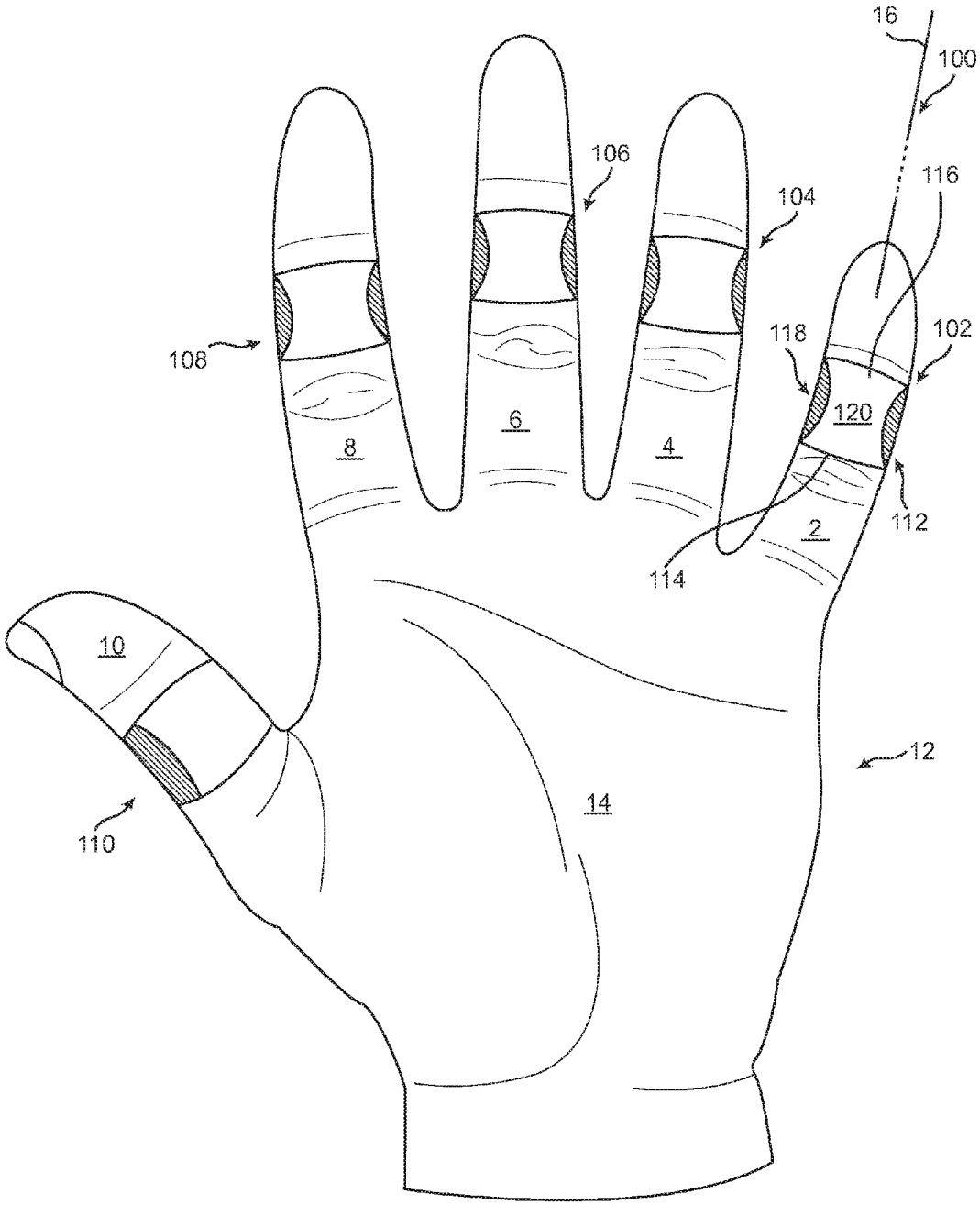
FIG. 1 is an environmental front elevational view of grip enhancing apparatus according to at least one aspect of the invention.

Referring first to FIG. 1, according to at least one aspect of the invention, there is shown grip enhancing apparatus 100 for the fingers 2, 4, 6, and 8 and thumb 10 of a wearer. The grip enhancing apparatus 100 may comprise a group or set of sleeves 102, 104, 106, 108, 110. Each sleeve 104, 106, 108, or 110 may share characteristics of the sleeve 102. Hence, description will refer to one sleeve such as the sleeve 102, with the understanding that the remaining sleeves 104, 106, 108, or 110 in FIGS. 1 and 2 may be similar in structure and function. The same applies to all other sets of sleeves shown and described herein.

The sleeve 102 is dimensioned and configured to be worn on the finger 2 of one hand 12 of the wearer. The sleeve 102 may comprise a mildly constricting tubular sheath 112 having an open proximal end 114 and an opposed distal end 116, and an external surface comprising a grip zone 118 bearing a friction increasing material 120. The grip zone 118 covers less than the full extent of the external surface, leaving a zone 122 which is devoid of the friction increasing material 120.

Description of the sheath as tubular is intended to convey that the sheath fully encircles any one finger along at least part of the length of the finger, but does not necessarily imply a circular cross section since the material is fairly pliable and will not maintain any one cross sectional configuration.

The constituent material of the sheath of the sleeve 102 may be for example a woven or unwoven fabric of any suitable constituency and construction which is air permeable, thereby enabling the sheath to "breathe", or to dissipate perspiration from the skin through the sheath to ambient air. This constituent material may comprise artificial fibers such as nylon, rayon, polyester, and others, or a natural fiber such as cotton, or still other types of natural and synthetic fibers, and blends or combinations of these fibers. The selected fibers will be resistant to deterioration by exposure to perspiration, or sweat resistant.

The friction increasing material 120 may be of several types. For example, the constituent material may be a rubbery natural or synthetic material, and may bear a plain untextured surface, or may bear a textured surface. A textured surface is one in which outwardly facing projections such as ridges, bumps, and other structures are formed. Alternatively, a textured surface may comprise inwardly facing structures such as dimples.

Another example of a friction increasing material 120 is a tacky substance such as Stickum®, which may take several forms, each of which is a product of Mueller Sports Medicine, Inc., One Quench Drive, Prairie du Sac, Wis. 53578, which is distributed nationally in various retail outlets.

The grip zone 118 does not encircle the tubular sheath of the sleeve 102, but rather extends along that side of the finger 2 which faces the same direction as the palm 14 of the hand 12. Of course, because the sheath of the sleeve 102 is flexible, the sleeve may be donned so that the grip zone 118 faces another direction. Because most grasping is done by closing the fingers 2, 4, 6, 8 and the thumb 10 over the palm 14, it is contemplated that in most cases, the grip zone 118 will be advantageously oriented as shown and described. Description of the grip zone 118 as being oriented as described is intended merely as a semantic convenience to distinguish the sleeve 102 from other sleeves presented herein. With this understanding in mind, the grip zone 118 extends along most of the axial length of the tubular sheath. The axial length is that dimension which would be parallel to the longitudinal axis 16 of the finger 2.

Figure 2:
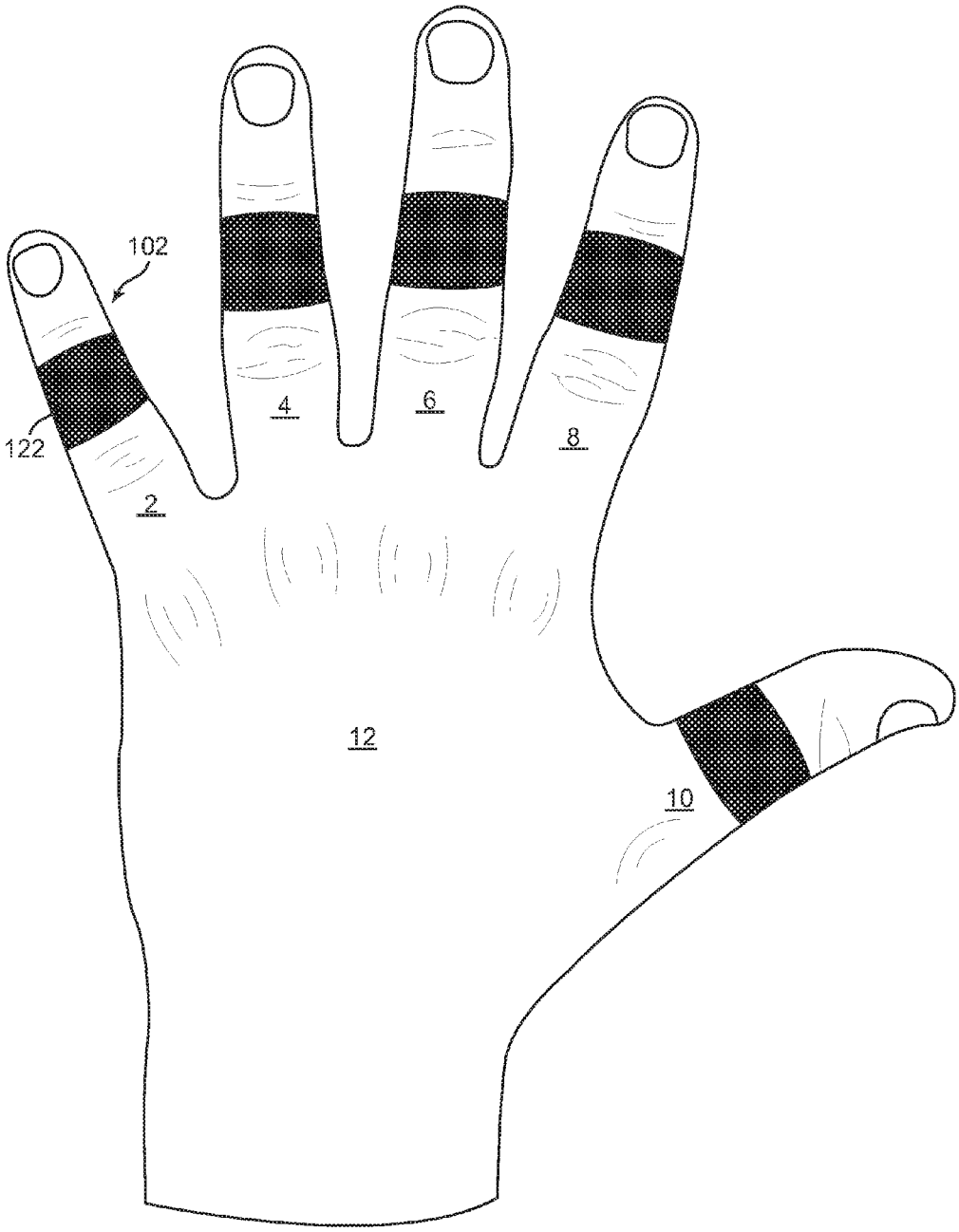
FIG. 2 is a rear view of FIG. 1.

In the embodiment of FIGS. 1 and 2, the sleeves 102, 104, 106, 108, 110 appear visually as rather broad rings, which have axial length not significantly greater than the diameter of the sheaths.

Figure 3:
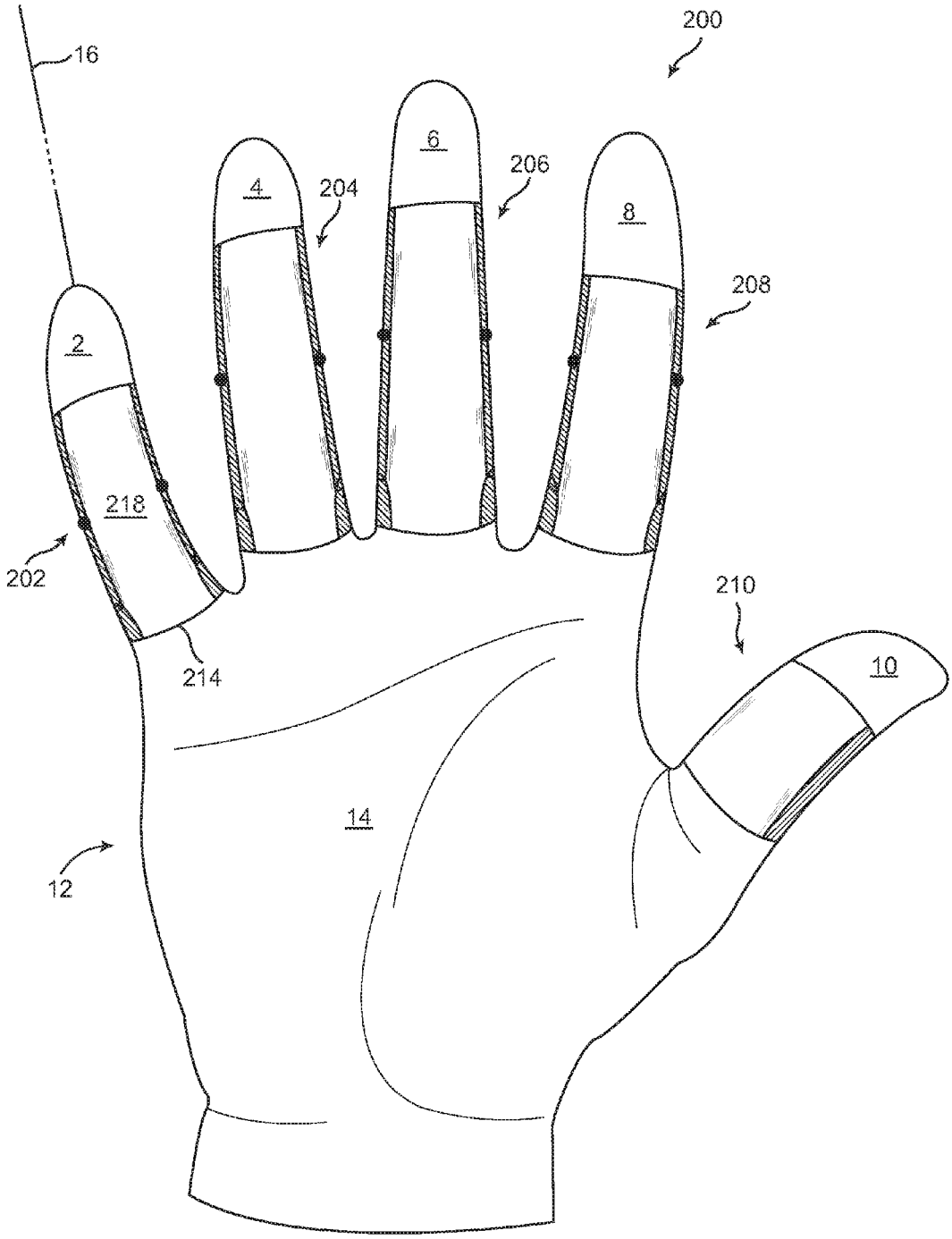
FIG. 3 is an environmental front elevational view of grip enhancing apparatus according to at least one further aspect of the invention.
Figure 4:
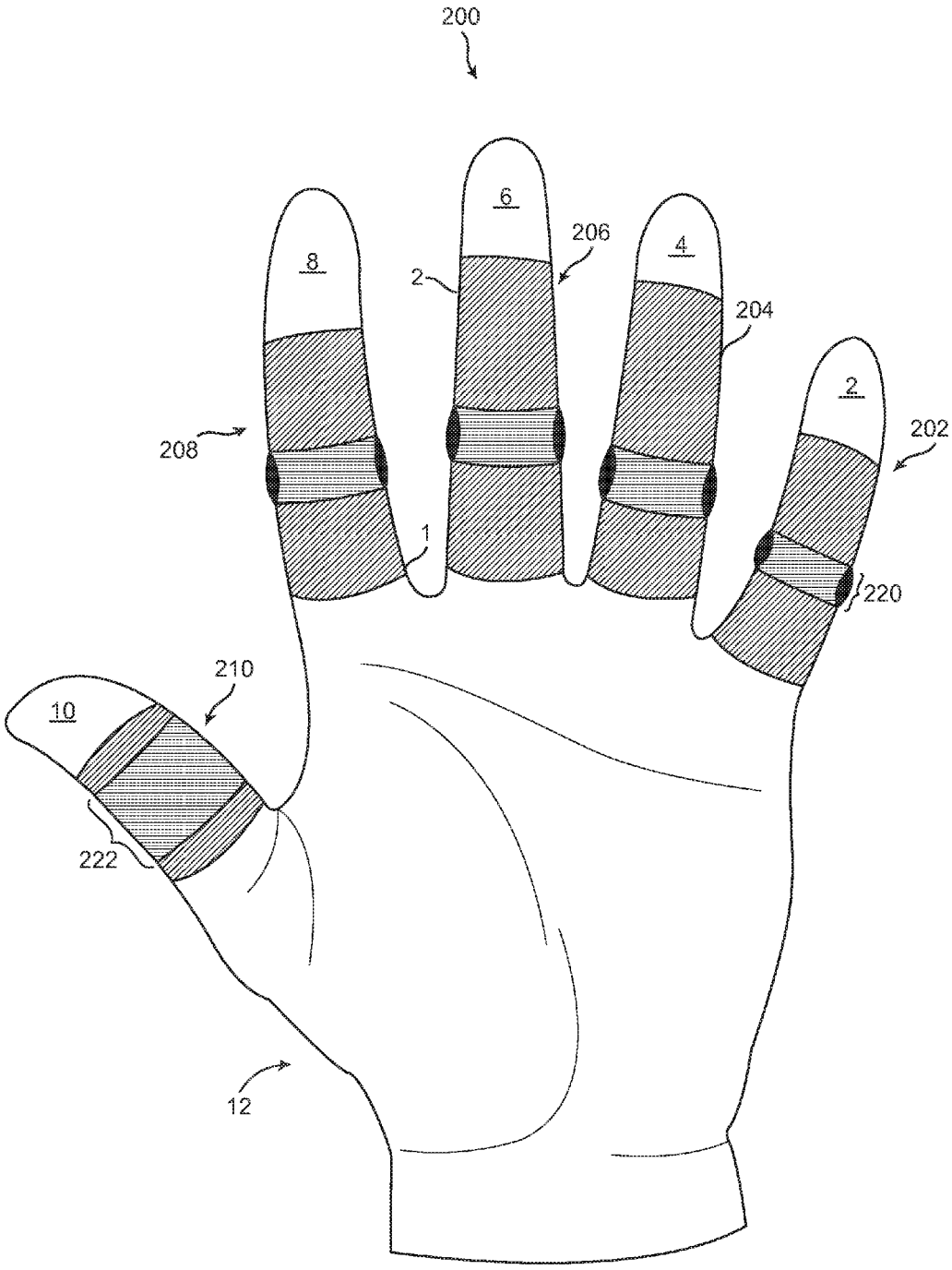
FIG. 4 is a rear view of FIG. 3.

Referring now to FIGS. 3 and 4, there is shown grip enhancing apparatus 200 for the fingers 2, 4, 6, and 8 and thumb 10 of a wearer. The grip enhancing apparatus 200 may comprise a group or set of sleeves 202, 204, 206, 208, 210 which are considerably greater in axial length than their respective counterparts 102, 104, 106, 108, 110 of FIG. 1. Also, the sleeves 202, 204, 206, 208, 210 each have an internal supplementary or reinforcing member to be described hereinafter. The general character of the constituent materials of the sheaths and grip zone 218 of the sleeve 202, which will be understood to be representative of the remaining sleeves 204, 206, 208, 210 may be the same as that of the sleeve 102.

The grip zone 218 of the sleeve 202 fully encircles the tubular sheath and extends along less than half of the axial length of the tubular sheath.

The sleeve 202 also incorporates an internal reinforcing member 220 (see FIG. 4) which is less pliable than the tubular sheath and is coupled to the tubular sheath. The internal reinforcing member 220 may comprise a thicker fabric, a different material such as natural or synthetic rubber or leather, or of still other constituency. The internal reinforcing member 220 may avoid encroaching upon the grip zone 218, and thus would be shown mostly from the rear view of the hand 12, as seen in FIG. 4. The reinforcing member 220 may be internal either by being sandwiched between two plies or layers of the sheath of the sleeve 202, where the sleeve 202 is so fabricated, may be worn inside the sheath of the sleeve 202 so as to contact the finger 2 directly, or may be incorporated into the sleeve 202 in other ways. Regardless of its constituency, it is seen that the reinforcing member 220 at least partially encircles the tubular sheath and extends along the axial length of the tubular sheath for a distance less than the full axial length of the tubular sheath. The reinforcing member 220 could if desired be arranged to fully encircle the tubular sheath, provided it does not cover or functionally interfere with the grip zone 218.

The axial length of a reinforcing member, such as the reinforcing member 222 of the sleeve 210 for the thumb 10, may extend along the axial length of the tubular sheath for a distance greater than half of the full axial length of the associated sleeve 210.

Figure 5:
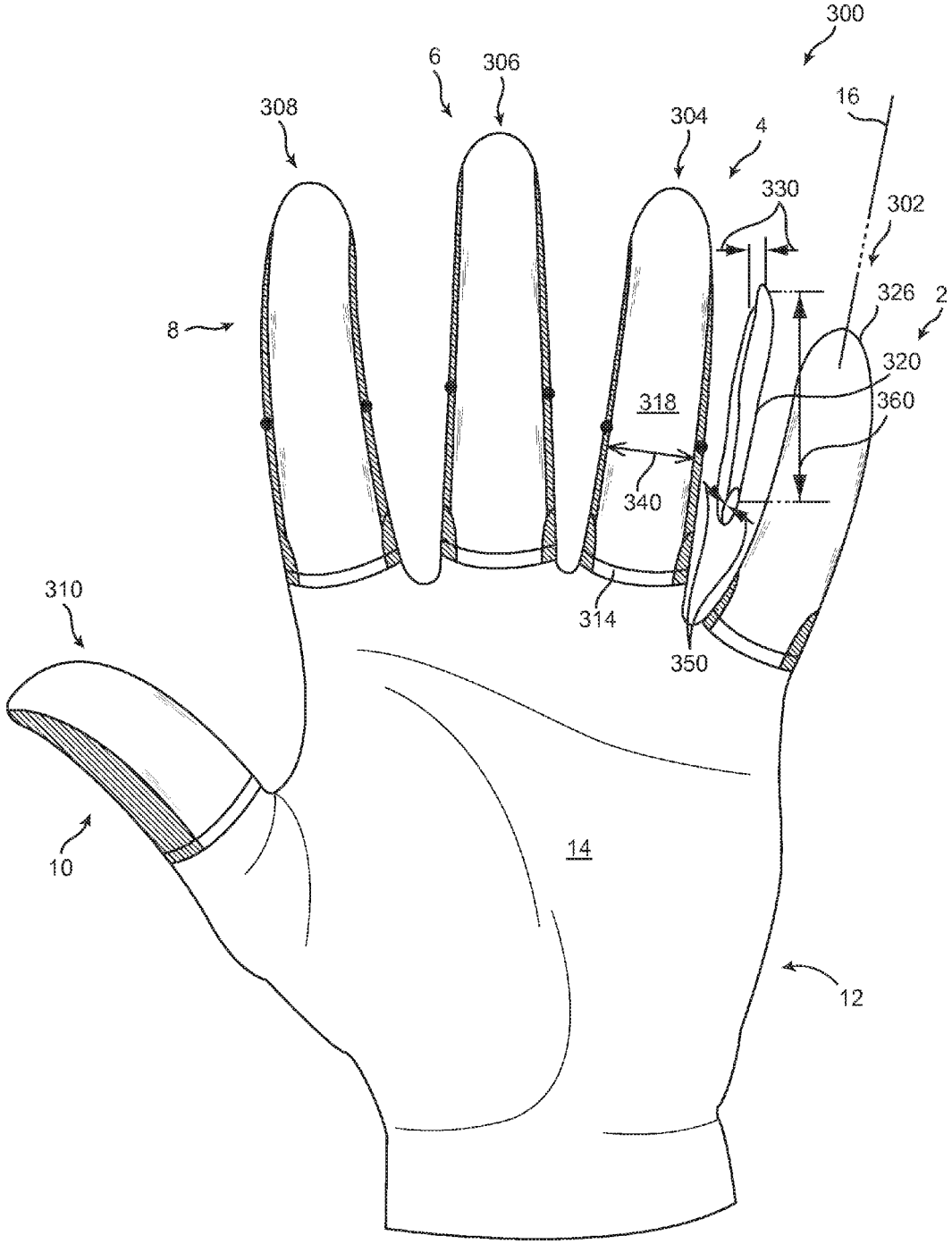
FIG. 5 is an environmental front elevational view of grip enhancing apparatus according to at least still another aspect of the invention.
Figure 6:
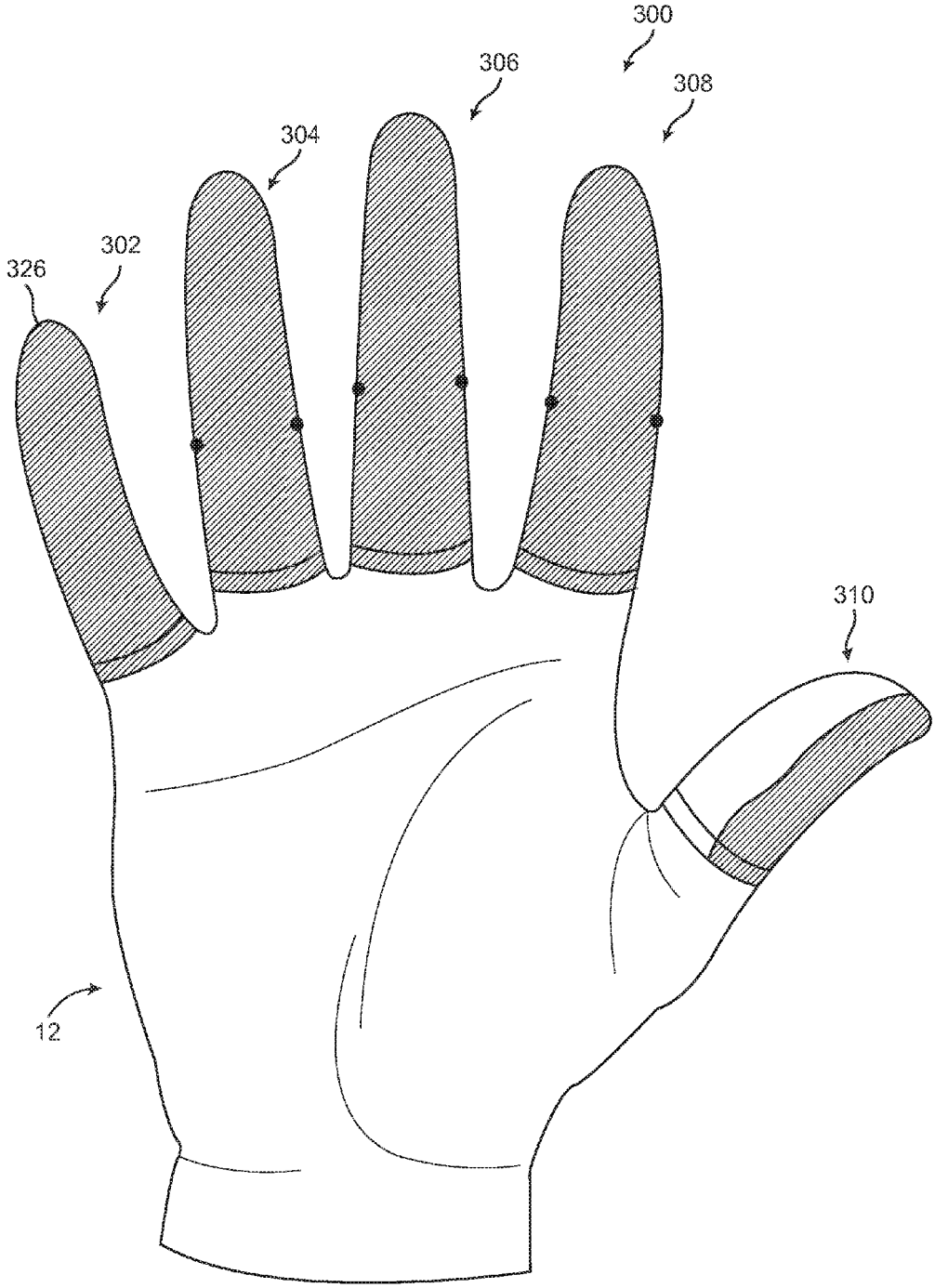
FIG. 6 is a rear view of FIG. 5.

FIGS. 5 and 6 show a grip enhancing apparatus 300 for the fingers 2, 4, 6, and 8 and thumb 10 of a wearer. The grip enhancing apparatus 300 may comprise a group or set of sleeves 302, 304, 306, 308, 310 which are considerably greater in axial length than their respective counterparts 102, 104, 106, 108, 110 of FIG. 1. Notably, the sheath of each one of the sleeves 302, 304, 306, 308, 310 extends the full length of its associated finger 2, 4, 6, 8 or thumb 10. Moreover, the distal ends of each tubular sheath, such as the distal end 326 of the sleeve 302, are closed and cover the tip of their associated fingers, such as the finger 2. The general character of the constituent materials of the sheaths and grip zone 218 of the sleeve 202, which will be understood to be representative of the remaining sleeves 204, 206, 208, 210 may be the same as that of the sleeve 102.

Also, the sleeves 302, 304, 306, 308, 310 each may have an internal supplementary or reinforcing member such as a reinforcing member 320 (shown for the sleeve 304, but which will be understood to be representative for the remaining sleeves 302, 306, 308, 310) which may comprise a bendable splint. The reinforcing member 320 may be formed from a mildly pliable or flexible material such as polyethylene for example. The reinforcing member 320 may have a width (indicated by opposed arrows 330) which does not exceed half the diameter 340 of the tubular sheath. The reinforcing member 320 may have a thickness (indicated by opposed arrows 350) which is no greater than half of the width. The reinforcing member 320 may extend in length 360 along the tubular sheath at least half of the length of the finger 4 of the wearer.

The reinforcing member 320 may be incorporated into its associated sleeve 304 in any suitable way, such as by being enveloped between two plies, where the sleeve 304 is so constructed, by being adhered to the interior of the sheath of the sleeve 304, or in other ways.

Figure 7:
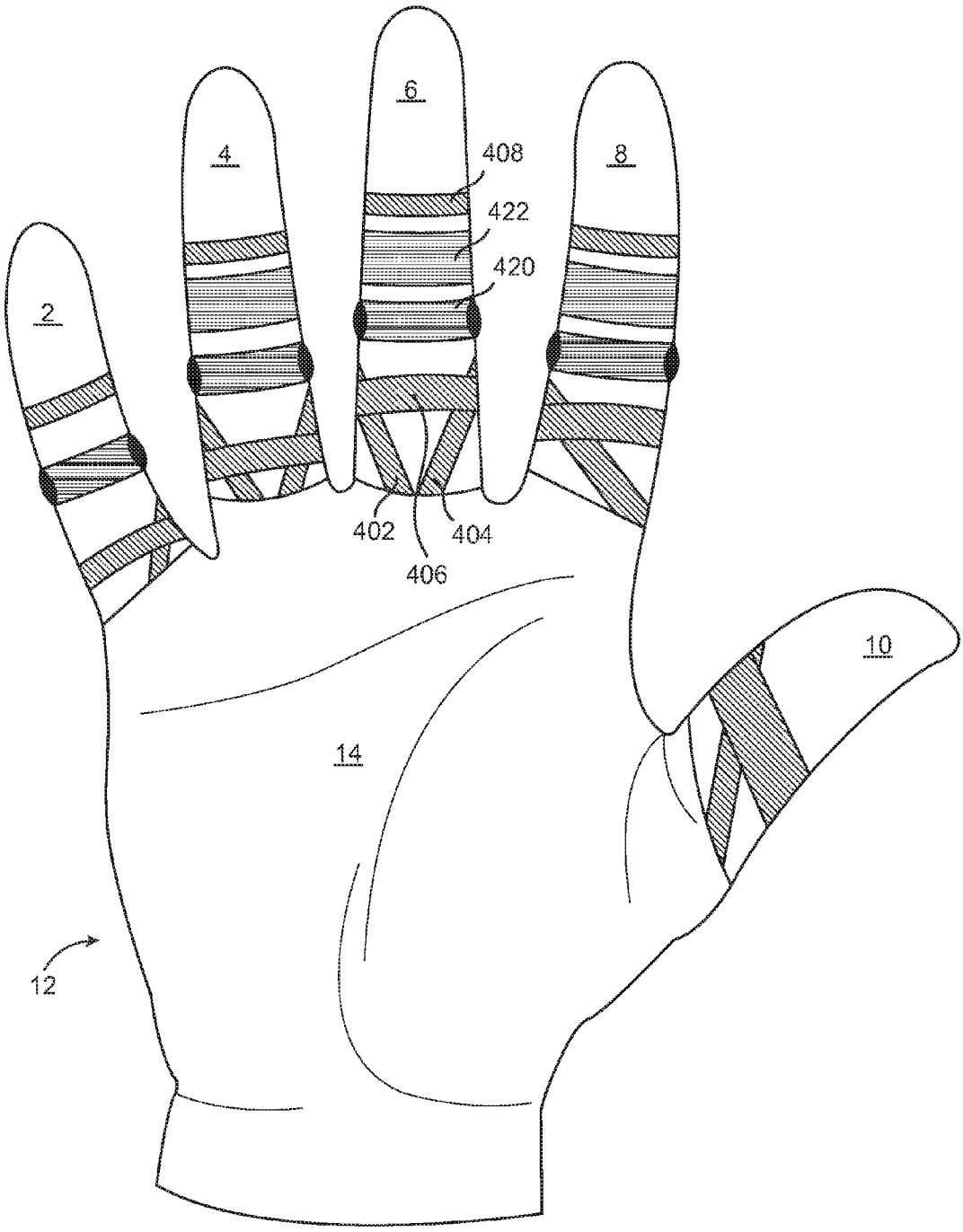
FIG. 7 is a diagrammatic environmental plan view of components which may be incorporated into the grip enhancing apparatus of FIGS. 4 and 6.

FIG. 7 shows a form of reinforcement which may be incorporated into the sleeves of any of the apparatuses of adequate length, such as the grip enhancing apparatuses 200 and 300. FIG. 7 is diagrammatic in that the subject matter will be incorporated into sheath structure which is omitted from FIG. 7 to preserve clarity of the view. In practice, it is contemplated that the elements newly presented in FIG. 7 will be fully contained within the interior of the sheath structure or alternatively, adhered to the interior surface of the sheath structure. Regardless of which option is practiced, the described elements will be disposed internally within the tubular sheath.

Again using one finger 6 as representative of the remaining fingers 2, 4, 8, 10, a reinforcement arrangement may comprise a first elastic band 402, a second elastic band 404, and a third elastic band 406, all of which are arranged to overlie at least one of the remaining elastic bands 402, 404, 406, to form an acute angle at their mutual intersections where they overlie one another, and to encircle the finger 6. The first elastic band 402, the second elastic band 404, and the third elastic band 406 are located proximate the proximal ends of their associated tubular sheaths (such as the proximal ends 214 seen in FIGS. 3 and 314 seen in FIG. 5). The assembly comprising overlying elastic bands 402, 404, 406 extends less than half of the axial length of the tubular sheath of the associated sleeve, such as the sleeves 202 of FIG. 3 or 304 of FIG. 5.

The assembly of overlying elastic bands 402, 404, 406 may be supplemented by a further elastic band 408 which is disposed to encircle the finger 6 and which is located away from and out of contact with the elastic bands 402, 404, 406.

The various reinforcing members presented herein may be combined in any one sleeve such as the sleeve 304 for example, where such combination is feasible. Illustratively, and continuing to refer to FIG. 7, the elastic bands 402, 404, 406, and 408 may be used in conjunction with a reinforcement member 420 and an elastic fabric band 422. The reinforcement member 420 may be the structural and functional equivalent of the reinforcement member 220 of FIG. 4 for example, and may be located so as to protect a joint or knuckle of the finger 6. The elastic fabric band 422 may be of a stretchable synthetic fiber, such as spandex for example, and may cover a part of the finger 6 between two joints or knuckles. It will be appreciated that the elastic bands 402, 404, 406, 408, the reinforcement members 420, and the elastic fabric band 422 do not conflict with one another and thus may all be incorporated into a sleeve such as the sleeve 304.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible

I claim:

1. Grip enhancing apparatus for the fingers of a wearer, comprising a set of sleeves wherein each sleeve is dimensioned and configured to be worn on one finger or thumb of one hand of the wearer, each sleeve comprises a constricting tubular sheath having an open proximal end and an opposed distal end and an external surface comprising a grip zone bearing a friction increasing material, wherein the grip zone covers less than the full extent of the external surface, and wherein each sleeve comprises at least a first elastic band and a second elastic band disposed internally within the tubular sheath and which are arranged at an acute angle to one another and which encircle the finger.

2. The grip enhancing apparatus of claim 1, wherein the grip zone fully encircles the tubular sheath and extends along less than half of the axial length of the tubular sheath.

3. The grip enhancing apparatus of claim 1, wherein the grip zone does not encircle the tubular sheath and extends along most of the axial length of the tubular sheath.

4. The grip enhancing apparatus of claim 1, wherein the tubular sheath is fabricated from an air permeable fabric material.

5. The grip enhancing apparatus of claim 1, wherein the tubular sheath is fabricated from a sweat resistant material.

6. The grip enhancing apparatus of claim 1, further comprising a reinforcing member which is less pliable than the tubular sheath and is coupled to the tubular sheath.

7. The grip enhancing apparatus of claim 6, wherein the reinforcing member encircles the tubular sheath and extends along the axial length of the tubular sheath for a distance less than the axial length of the tubular sheath.

8. The grip enhancing apparatus of claim 6, wherein the reinforcing member extends along the axial length of the tubular sheath for a distance of at least most of the axial length of the tubular sheath, and does not encircle the tubular sheath.

9. The grip enhancing apparatus of claim 8, wherein the reinforcing member comprises a bendable splint which in width does not exceed half the diameter of the tubular sheath, in thickness is no greater than half of the width, and which extends along the tubular sheath at least half of the length of the finger of the wearer.

10. The grip enhancing apparatus of claim 1, wherein the first elastic band and the second elastic band are located proximate the proximal end of its associated tubular sheath and extends less than half of the axial length of the associated tubular sheath.

11. The grip enhancing apparatus of claim 10, further comprising at least one third elastic band which is disposed to encircle the finger and which is located away from and out of contact with the first elastic band and the second elastic band.

12. The grip enhancing apparatus of claim 1, wherein each tubular sheath extends the full length of its associated finger.

13. The grip enhancing apparatus of claim 1, wherein the distal end of each tubular sheath is closed and covers the tip of its associated finger.

* * * * *